US009457600B2

(12) United States Patent
Horaguchi

(10) Patent No.: US 9,457,600 B2
(45) Date of Patent: Oct. 4, 2016

(54) CONVEYANCE DEVICE, PRINTING DEVICE, AND CONVEYANCE METHOD

(75) Inventor: Norio Horaguchi, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 932 days.

(21) Appl. No.: 13/491,011

(22) Filed: Jun. 7, 2012

(65) Prior Publication Data

US 2012/0312855 A1 Dec. 13, 2012

(30) Foreign Application Priority Data

Jun. 8, 2011 (JP) ..... 2011-128702
Jun. 9, 2011 (JP) ..... 2011-128961

(51) Int. Cl.
*B41J 15/00* (2006.01)
*B65H 20/04* (2006.01)
*B65H 23/04* (2006.01)

(52) U.S. Cl.
CPC ..... *B41J 15/005* (2013.01); *B65H 20/04* (2013.01); *B65H 23/042* (2013.01)

(58) Field of Classification Search
CPC ..... B41J 15/005; B41J 15/04; B41J 11/42; B41J 29/38; B65H 20/02; B65H 20/04; B65H 23/042; B65H 23/188; B65H 23/192; B65H 2301/52
See application file for complete search history.

(56) References Cited

U.S. PATENT DOCUMENTS 5,222,728 A * 6/1993 Takahashi ..... 271/242
5,724,085 A * 3/1998 Inui et al. ..... 347/175
6,112,655 A 9/2000 Suzuki et al.
7,878,723 B2 2/2011 Igarashi et al.
2007/0146405 A1 6/2007 Yoshida
2009/0255971 A1* 10/2009 Nakamaki et al. ..... 226/1
2009/0269119 A1 10/2009 Hatada et al.
2010/0053251 A1* 3/2010 Igarashi ..... B41J 3/543 347/16
2013/0042807 A1* 2/2013 Noguchi ..... B65H 18/10 242/564.4

FOREIGN PATENT DOCUMENTS

CN 1221682 A 7/1999
CN 201275897 Y 7/2009
CN 101564941 A 10/2009
CN 201511591 U 6/2010
JP 04-159950 A 6/1992
JP 09-123554 A 5/1997
JP 2005-041617 A 2/2005
JP 2005-231829 A 9/2005

(Continued)

*Primary Examiner* — Michael Mansen
*Assistant Examiner* — Nathaniel Adams
(74) *Attorney, Agent, or Firm* — Nutter McClennen & Fish LLP; John J. Penny, Jr.; Joshua I. Rudawitz

(57) ABSTRACT

A conveyance device including an upstream roller that supplies a sheet medium to be processed to a conveyance path; a downstream roller that conveys the supplied medium to a processing position; and a control unit that, in order to convey the sheet medium at a constant speed, controls driving the upstream roller and the downstream roller using the constant speed as a target speed. The control unit changes the target speed of the upstream roller to eliminate a conveyance difference, which is the difference between the length of media conveyed by the upstream roller and the length of media conveyed by the downstream roller from the start of the conveyance operation, based on the conveyance difference in each conveyance operation.

14 Claims, 5 Drawing Sheets

(56) References Cited

FOREIGN PATENT DOCUMENTS

| | | | |
|---|---|---|---|
| JP | 2008-056367 | A | 3/2008 |
| JP | 2008-201522 | A | 9/2008 |
| JP | 2010-274483 | A | 12/2010 |
| JP | 2011-093326 | A | 5/2011 |

* cited by examiner

CONVEYANCE DEVICE, PRINTING DEVICE, AND CONVEYANCE METHOD

Priority is claimed under 35 U.S.C. §119 from Japanese Application Nos. 2011-128702 and 2011-128961 filed on Jun. 8 and 9, 2011, respectively, both of which are hereby incorporated by reference in their entireties.

BACKGROUND

1. Technical Field

The present invention relates to devices that use two sets of rollers to convey sheet media to a processing position, and relates more particularly to a conveyance device, printing device, and conveyance method that can maintain a consistent amount of slack in the sheet medium between the two sets of rollers and eliminate the effect of back tension on the downstream rollers without increasing device size.

2. Related Art

A means of conveying paper or other types of sheet media is required in order to process such media in a printer or other device. Such conveyance devices generally have upstream rollers that supply the media from the part storing the sheet medium to the conveyance path, and downstream rollers that convey the supplied medium through the conveyance path to the position where the media is printed or otherwise processed.

Such conveyance devices must be able to accurately control the conveyance speed of the medium from the downstream rollers in order to apply the printing or other process to the conveyed medium with good precision and high quality. Such control is difficult, however, if there is back tension from the upstream side pulling on the medium at the downstream rollers.

Technology for overcoming this problem is taught in Japanese Unexamined Patent Appl. Pub. JP-A-2008-56367. JP-A-2008-56367 teaches advancing the drive time or increasing the paper feed distance of the upstream rollers.

However, consistently controlling media conveyance appropriately as conveyance conditions change is a problem with the technology taught in JP-A-2008-56367 because the drive time is advanced or the paper feed distance is increased in the same way regardless of the current conditions. For example, the force applied to the rollers and the conveyance force of the rollers change according to roller wear and media storage conditions (such as the roll diameter when the medium is roll paper). As a result, if control is always based on the same fixed values, slack in the medium between the upstream rollers and downstream rollers may be lost, or excess slack may allow the medium to rub against parts disposed along the conveyance path, and back tension may be applied to the downstream rollers. Another problem is that device size must be increased in order to maintain excess slack at all times so that slack is not eliminated and prevent slack media from touching parts along the conveyance path.

More particularly, when media conveyance continues for a long time, the conveyance distance of both rollers may also change even when conveying the medium at a constant speed due, for example, to how the conveyed medium is stored (roll paper slack, fanfold paper), exacerbating the problems described above.

SUMMARY

A conveyance device, a printing device, and a media conveyance method according to the present invention enable conveying sheet media using two sets of rollers to a process position while maintaining a consistent amount of slack in the sheet medium between the two sets of rollers and eliminating the effect of back tension on the downstream rollers without increasing device size.

A conveyance device according to at least one embodiment of the invention includes an upstream roller that supplies a sheet medium to be processed to a conveyance path; a downstream roller that conveys the supplied medium to a processing position; and a control unit that, in order to convey the sheet medium at a constant speed, controls driving the upstream roller and the downstream roller using the constant speed as a target speed. The control unit changes the target speed of the upstream roller to eliminate a conveyance difference, which is the difference between the length of media conveyed by the upstream roller and the length of media conveyed by the downstream roller from the start of the conveyance operation, based on the conveyance difference in each conveyance operation.

A conveyance device according to another aspect of at least one embodiment of the invention preferably stores relationship information about the conveyance difference and the target speed of the upstream roller in advance, and changes the target speed according to the relationship information.

A conveyance device according to another aspect of at least one embodiment of the invention preferably also has follower rollers respectively disposed opposite the upstream roller and the downstream roller with the sheet medium therebetween; and encoders respectively disposed to the follower rollers; and the control unit determines the conveyance difference based on information detected by the encoders.

In a conveyance device according to another aspect of at least one embodiment of the invention, the relationship information is preferably stored for different types of sheet media.

A conveyance device according to another aspect of at least one embodiment of the invention preferably also has a slack detector that detects the amount of slack in the sheet medium between the upstream roller and the downstream roller; and the control unit corrects the conveyance difference based on a predetermined value and changes the target speed after the slack detector detects that the amount of slack in the sheet medium reached a predetermined upper limit or lower limit.

Yet further preferably, the sheet medium conveyance operation is stopped when the slack detector detects that the amount of slack in the sheet medium reached a predetermined upper limit or lower limit.

In another aspect of at least one embodiment of the invention, the sheet medium is preferably supplied from a roll to the upstream roller.

In another aspect of at least one embodiment of the invention, the control unit preferably determines the starting time of the upstream roller and the downstream roller when starting the conveyance operation based on drive information about the upstream roller and the downstream roller in a previous conveyance operation.

Another aspect of at least one embodiment of the invention is a printing device that includes the conveyance device of the invention, and prints on the sheet medium at the processing position.

Another aspect of at least one embodiment of the invention is a conveyance method of a conveyance device that has an upstream roller that supplies a sheet medium to be processed to a conveyance path, a downstream roller that conveys the supplied medium to a processing position, and a conveyance control unit that controls driving both rollers using the constant speed as the target speed of the upstream roller and the downstream roller using a target speed, the conveyance method having a step of: the control unit changing the target speed of the upstream roller to eliminate the difference between the length of media conveyed by the upstream roller and the length of media conveyed by the downstream roller from the start of the conveyance operation based on the conveyance difference in each conveyance operation.

Further preferably in a conveyance method another aspect of at least one embodiment of the invention, the conveyance device has a slack detector that detects the amount of slack in the sheet medium between the upstream roller and the downstream roller; and the conveyance method has a further step of correcting the conveyance difference based on a predetermined value and changing the target speed after the slack detector detects that the amount of slack in the sheet medium reached a predetermined upper limit or lower limit.

Further preferably in a conveyance method according to another aspect of at least one embodiment of the invention, the sheet medium conveyance operation is stopped when the slack detector detects that the amount of slack in the sheet medium reached a predetermined upper limit or lower limit.

Other objects and attainments together with a fuller understanding of the invention will become apparent and appreciated by referring to the following description and claims taken in conjunction with the accompanying drawings.

DESCRIPTION OF EMBODIMENTS

Figure 1:
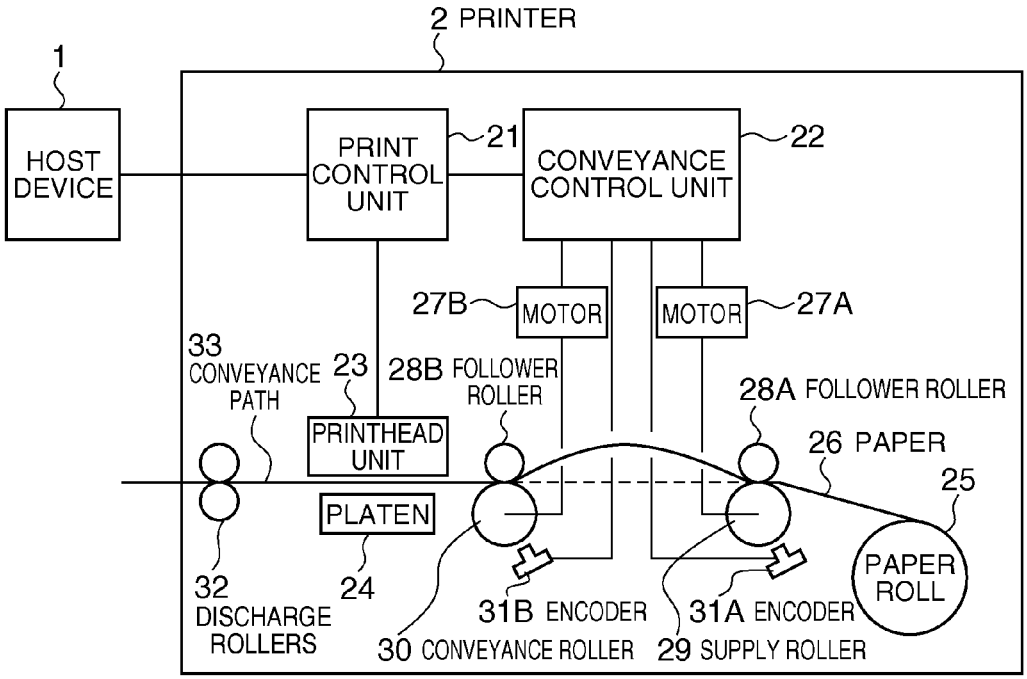
FIG. 1 is a block diagram of a preferred embodiment of a printing device having a conveyance device according to the invention.

A preferred embodiment of the invention is described below with reference to the accompanying figures. The following embodiment does not, however, limit the technological scope of the invention. Note that identical or similar parts are notified in the figures by the same reference numerals or reference symbols.

FIG. 1 is a block diagram of a preferred embodiment of a printing device having a conveyance device according to the invention. The printer 2 shown in FIG. 1 is a printing device according to this embodiment of the invention. The printing device conveys paper 26 used as the print medium past a printing position using a supply roller 29 (upstream roller) and conveyance roller 30 (downstream roller), and performs a printing process. The printing device changes the target speed of the supply roller 29 according to the difference in the length of media conveyed during the conveyance operation by both rollers from when roller drive starts so that this difference in media conveyance is eliminated and a constant amount of slack is maintained in the paper 26 between the rollers.

The printer 2 also appropriately delays the start of conveyance roller 30 operation based on the drive state of both rollers during acceleration in the previous conveyance operation in order to further maintain a constant amount of slack in the paper 26 between the rollers.

As shown in FIG. 1, the printer 2 is a device that receives commands from a computer or other host device 1 and performs a printing process, and in this embodiment is a printing device that uses roll paper 25 as the paper 26 and prints continuously while conveying the paper 26.

FIG. 1 is a block diagram showing the configuration of the printer 2. The printer 2 has a printing mechanism that controls the print content and performs a printing process on the paper 26, and a conveyance mechanism that handles conveying the paper 26.

A print control unit 21 is disposed in the printing mechanism. The print control unit 21 receives print commands from the host device 1, and outputs print commands to the printhead unit 23 and paper 26 conveyance commands to the conveyance control unit 22 of the conveyance mechanism based on the received print commands. The printhead unit 23 prints on the paper 26 moving at a specific speed between the printhead unit 23 and platen 24 according to the print commands.

As shown in FIG. 1, the conveyance mechanism performs a conveyance operation that conveys the paper 26 stored as a paper roll 25 in the print medium storage location through a conveyance path 33 to the printhead unit 23, and then discharges the paper 26 from the printer 2 through the discharge rollers 32.

A supply roller 29 (upstream roller) and conveyance roller 30 (downstream roller) that are driven by respective motors (27A, 27B) are provided for conveying the paper to the printhead unit 23. Follower rollers (28A, 28B) are disposed to apply pressure to the paper 26 at a position opposite each of these rollers with the paper 26 therebetween.

The supply roller 29, which functions to supply the paper 26 held as a paper roll 25 to the conveyance path 33, is driven by torque from the motor 27A transferred through a speed reducer, and conveys the paper 26 by means of friction produced by pressure applied to the paper 26 between the supply roller 29 and follower roller 28A.

The conveyance roller 30, which functions to convey the paper 26 supplied by the supply roller 29 to the printing position, or more specifically to the printhead unit 23 position, is driven by torque from the motor 27B transferred through a speed reducer, and conveys the paper 26 by means of friction produced by pressure applied to the paper 26 between the conveyance roller 30 and follower roller 28B.

Encoders 31A and 31B respectively disposed on the supply roller 29 and conveyance roller 30 detect the speed of the corresponding rollers and output the detected speed of each roller to the conveyance control unit 22. Note that encoders also may be disposed on the follower rollers 28A, 28B of the supply roller 29 and conveyance roller 30. Disposing the encoders to the follower rollers 28A, 28B generally enables more accurate measurement because slipping against the paper 26 occurs on the drive roller side and change in drive roller diameter over time due to wear is severe.

The conveyance control unit 22 shown in FIG. 1 controls the media conveyance system, and controls the conveyance operation of the paper 26 based on commands from the print control unit 21. More specifically, the conveyance control unit 22 controls driving and stopping the supply roller 29 and conveyance roller 30 to desirably convey the paper 26 to the printing position. The method of controlling driving and stopping the supply roller 29 and conveyance roller 30 is a characteristic feature of this printer 2, and is described in detail below.

The conveyance control unit 22 includes a CPU, ROM, RAM and NVRAM (nonvolatile memory) not shown in the figures, and the foregoing process performed by the conveyance control unit 22 is achieved by the CPU operating primarily according to a program stored in ROM.

Required process data is temporarily stored in RAM, and the wait time ΔT described below and drive data from the conveyance operation required for controlling driving and stopping the supply roller 29 and conveyance roller 30 are also stored in RAM. The stored drive data includes the drive start time and conveyance speed of the supply roller 29 and conveyance roller 30, and the duty of each corresponding motor 27 (the current supplied to the motors 27 in this example), are included in the stored drive data.

Relationship information for determining the wait time ΔT, and relationship information for determining the target speed of the supply roller 29, are stored in advance in NVRAM. This relationship information is described below.

Note that the media conveyance system including the supply roller 29, conveyance roller 30, and conveyance control unit 22 corresponds to the conveyance device of the invention.

The printer 2 configured as described above is characterized by the method of controlling paper 26 conveyance as described in detail below.

As described above, the printer 2 performs a printing process on the paper 26 conveyed at a specific (constant) speed. The conveyance control unit 22 basically controls driving the supply roller 29 and conveyance roller 30 so that the conveyance speed of the rollers quickly reaches the specific conveyance speed when the printing process starts, maintains that specific conveyance speed until the printing process ends, and then stops both rollers when the printing process ends. This conveyance operation and conveyance process are repeated each time the printing process is executed.

When the paper 26 is first loaded, the conveyance control unit 22 controls the rollers so that a specific amount of slack (slack such as shown in FIG. 1, for example) is created in the paper 26 between the supply roller 29 and conveyance roller 30, and conveys the paper 26 to a specific position. As described above, this is to prevent back tension from acting on the conveyance roller 30, and thereby enables consistently supplying the paper 26 at a constant speed from the conveyance roller 30 to the printing position.

Because back tension is applied to the supply roller 29 by the inertia (load) of the paper roll 25 located upstream, the supply roller 29 is normally subject to greater back tension than the conveyance roller 30 during paper 26 conveyance.

Figure 2:
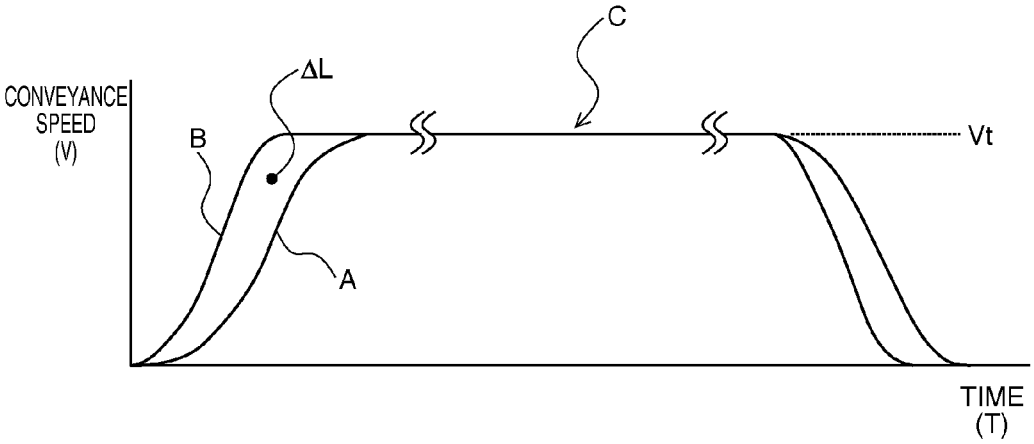
FIG. 2 shows an example of the behavior of a supply roller 29 and conveyance roller 30 during the media conveyance operation.

The supply roller 29 therefore tends to take more time to reach the specific speed at the start of the conveyance operation. FIG. 2 shows an example of the behavior of the supply roller 29 and conveyance roller 30 in the conveyance operation. The x-axis in FIG. 2 shows the time (T) passed after drive starts, and the y-axis shows the conveyance speed (V) of each roller. Curve A in the graph shows the behavior of the supply roller 29, and curve B shows the behavior of the conveyance roller 30.

As described above, because greater back tension is applied to the supply roller 29 than the conveyance roller 30, the rise of the conveyance speed to the targeted specific speed (Vt) is more gradual for the supply roller 29 (curve A) as shown in FIG. 2. A difference in the amount of paper conveyed by both rollers therefore occurs before both rollers reach the specified speed. A conveyance difference (ΔL) equal to the area between curve B and curve A occurs in the example shown in FIG. 2.

As a result, if both rollers start simultaneously when the conveyance operation starts, the conveyance roller 30 will convey the paper a conveyance difference ΔL more by the time both rollers reach the specific speed Vt and are controlled to the same paper feed amount. This reduces the amount of slack in the paper 26, and depending upon the conveyance difference ΔL could result in the elimination of slack. One purpose of the conveyance control unit 22 in this printer 2 is therefore to eliminate this conveyance difference at the start of this operation (during acceleration).

As described above, a difference in the conveyance distance of the supply roller 29 and conveyance roller 30 can also occur after the specific speed Vt is reached (during the period denoted C in FIG. 2), particularly when this period is long. Control during this period basically works to maintain the target conveyance speed of both rollers at the specific speed Vt, but because control attempts to return the conveyance speed to the specific speed Vt when the conveyance speed deviates from the specific speed Vt due, for example, to a change in the load on a roller without considering the difference in the conveyance distance resulting from deviation in the conveyance speed, a difference in the length of media conveyed by each roller may occur.

This paper feed difference causes the amount of constant slack to change, and is undesirable. Eliminating a difference in the amount of media conveyed during conveyance at a constant speed is another objective of control by the conveyance control unit 22.

The conveyance control unit 22 in this embodiment of the invention therefore applies control to achieve the foregoing objectives and keep the slack produced in the initial state substantially constant during each conveyance operation. This control method is described in detail below.

Figure 3:
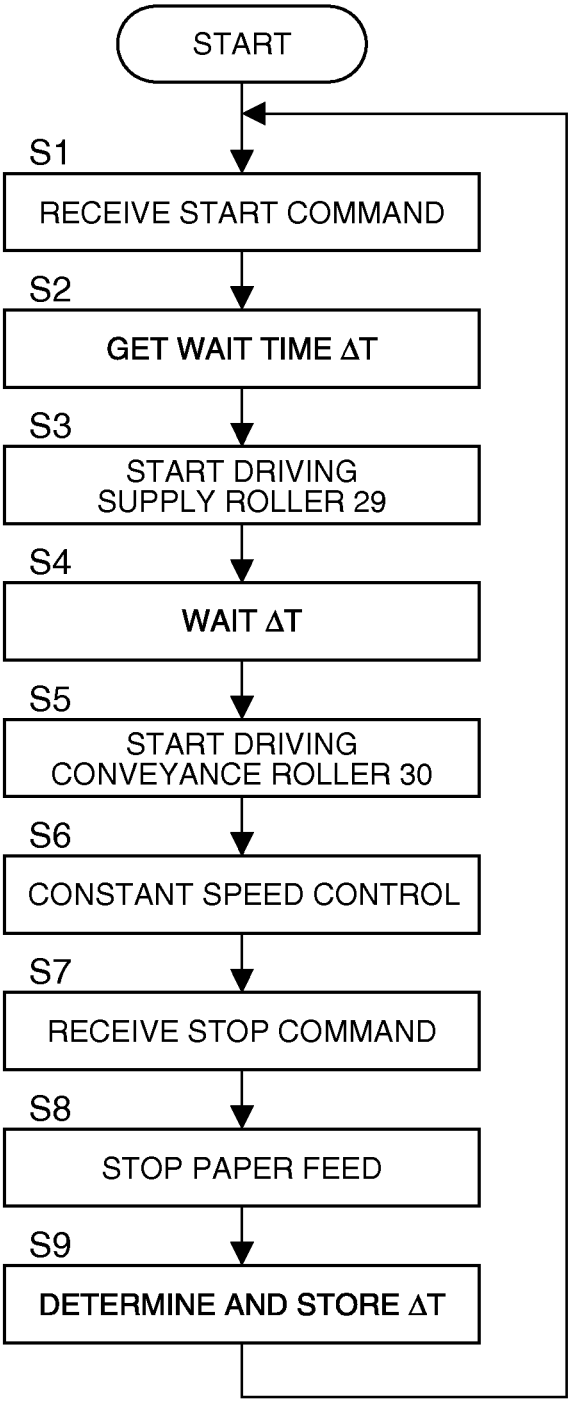
FIG. 3 is a flow chart showing steps in the process executed by a conveyance control unit 22.

FIG. 3 is a flow chart showing steps in the process executed by the conveyance control unit 22. Control of the conveyance operation is described below with reference to FIG. 3. Note that a feature of this control is eliminating the conveyance (paper feed) difference when drive starts by delaying the start of conveyance roller 30 operation, and the timing when conveyance roller 30 operation starts is determined based on drive data from the previous conveyance operation that accurately represents current operating conditions, such as how much roll paper 25 remains.

Methods that use the difference in the rise time of the supply roller 29 and conveyance roller 30 (the difference in the time required to reach the specific speed Vt), the difference (ΔL) in the amount of media conveyed before the supply roller 29 and conveyance roller 30 reach the specific speed Vt, and the duty difference (ΔD) of the motors 27 that drive the supply roller 29 and conveyance roller 30 after the specific speed is reached, as the drive data can be executed.

Another feature of this control is changing the target speed of the supply roller 29 during constant-speed conveyance according to the conveyance difference from the start of the conveyance operation of both rollers detected at that time in order to eliminate the conveyance difference that could not be eliminated by adjusting the starting time and the conveyance difference that occurs during constant-speed conveyance as described above.

When a start paper feed command is received from the print control unit 21 for a conveyance operation (step S1), the conveyance control unit 22 first retrieves the wait time ΔT stored in RAM as described above (step S2). This wait time ΔT is the time that the start of conveyance roller 30 operation is delayed, and is information that is determined after each conveyance operation ends and is stored for the next conveyance operation. More specifically, the wait time ΔT is the value that was determined in the previous conveyance operation, and is determined as described more specifically below.

Note that for the first conveyance operation after the printer 2 turns on a predetermined default value stored in NVRAM is acquired. Alternatively, the value of the wait time ΔT determined in each conveyance operation could be stored in NVRAM and the wait time ΔT acquired therefrom.

The conveyance control unit 22 starts driving the supply roller 29 after this command is received (step S3). More specifically, the conveyance control unit 22 starts the motor 27A and continues control so that the conveyance speed of the supply roller 29 reaches the specific speed Vt target (target speed). Note that the conveyance control unit 22 controls driving the supply roller 29 and conveyance roller 30 by means of PID control based on output from the encoders 31A and 31B.

After starting driving of the supply roller 29, the conveyance control unit 22 waits for the acquired wait time ΔT to pass (step S4), and then starts driving the conveyance roller 30 (step S5). More specifically, the conveyance control unit 22 starts the motor 27B and continues control so that the conveyance speed of the conveyance roller 30 reaches the specific speed target.

By thus delaying the start of conveyance roller 30 operation by wait time ΔT, the conveyance difference at the start of operation can be substantially eliminated. This is described more specifically below.

When the supply roller 29 and conveyance roller 30 then reach the specific speed Vt, the conveyance control unit 22 controls driving the rollers at the constant speed (step S6). Because the paper 26 must be supplied to the printing position consistently at a constant speed, PID control using the specific speed Vt as the target speed is applied to the conveyance roller 30.

The supply roller 29 is also basically controlled by PID control using the specific speed Vt as the target speed similarly to the conveyance roller 30, but when a difference (ΔL) in the length of media conveyed by both rollers from the start of operation occurs, the target speed of PID control is shifted a specific amount from the specific speed Vt so that this conveyance difference goes to zero. More specifically, if the length of media conveyed by the supply roller 29 is greater than the length conveyed by the conveyance roller 30, the target speed is reduced from the specific speed Vt for PID control, but if the length conveyed by the supply roller 29 is less, the target speed is increased from specific speed Vt.

More specifically, using relationship information G that is stored in NVRAM for determining the target speed, the change ΔV from the specific speed Vt is obtained from the equation $\Delta V = G \times \Delta L$, and this change ΔV is used to determine the target speed ($=Vt+\Delta V$), which is the target for PID control at that time.

Figure 4A:
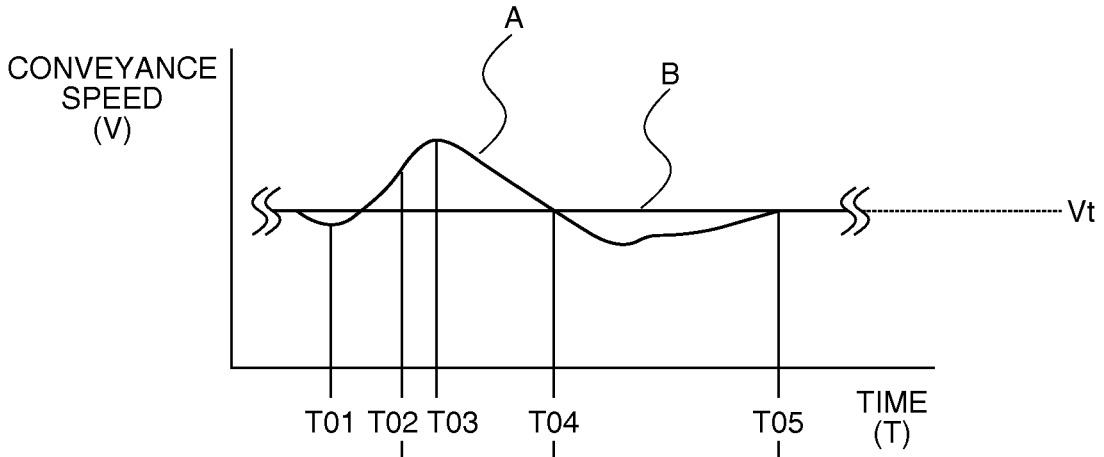
FIGS. 4A and 4B describe control during conveyance at a constant speed.
Figure 4B:
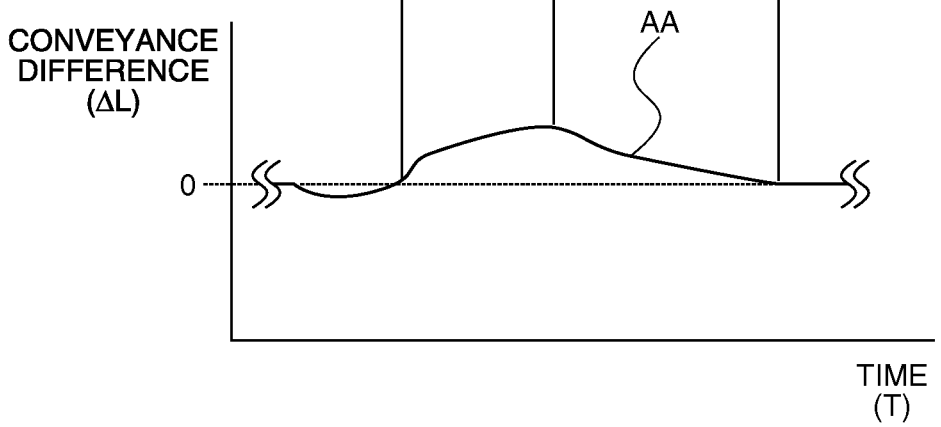

FIGS. 4A and 4B describe control during constant-speed conveyance. FIG. 4A shows the conveyance speed VA of the supply roller 29 (curve A in the figure) and the conveyance roller 30 (curve B in the figure) during constant-speed conveyance. FIG. 4B shows the change over time (curve AA) in the conveyance difference ΔL of the rollers. This example anticipates a sudden fluctuation in the load on the supply roller 29 from time T01 to time T03, and the resulting change in the speed of the supply roller 29 due to PID control. Note that the conveyance roller 30 is controlled substantially constantly at specific speed Vt.

Because the conveyance distance of the supply roller 29 is greater than the conveyance distance of the conveyance roller 30 after time T02, PID control is applied to the supply roller 29 using a target speed that is appropriately lower than the specific speed Vt by setting the target speed of the supply roller 29 as described above. The speed peaks at time T03 due to the above fluctuation and then gradually decreases, and the actual speed after time T04 is slower than the specific speed Vt. As indicated by curve AA, the conveyance difference ΔL starts to decrease, and when the difference goes to zero (time T05), the target speed of the supply roller 29 is controlled to return to the specific speed Vt.

Note that using a control that simply sets the target speed to the specific speed Vt, the speed of the supply roller 29 gradually decreases from time T03 to near Vt if there is no change in the load, and control then continues without the conveyance difference ΔL going to zero.

By controlling operation during constant-speed conveyance in this way, the conveyance difference that occurs during acceleration and that could not be completely eliminated by control based on the wait time ΔT, and conveyance difference occurring during constant-speed conveyance, can be eliminated by real-time control. Note that this conveyance difference is determined from the values detected by the encoders 31A and 31B.

The relationship information G (a constant in this example) is a desirable value that is determined experimentally and stored in memory. This relationship information G differs according to the type of paper, such as the material or thickness of the paper 26, and values suitable for different paper types are preferably determined and identifiably stored in NVRAM. In this case, paper type information is received when the start paper feed command is received from the print control unit 21 (S1), for example, and control uses the appropriate relationship information based on the received information.

Further preferably, the relationship information G changes according to the amount of back tension applied to the supply roller 29, and the relationship information G is adjusted according to the diameter of the paper roll 25, which affects the back tension. More specifically, the relationship information G may be expressed as a function that uses the roll diameter as a variable. In this case, the roll diameter used for control can be determined using a method that directly measures the roll diameter with a contact sensor or reflective sensor disposed in the printer 2, or a method that estimates the roll diameter based on the number of paper roll 25 revolutions after the paper roll 25 is loaded or information (total conveyance distance) detected by the encoders 31A and 31B after the paper roll 25 is loaded.

Note, further, that this relationship between the information for determining the target speed (conveyance difference ΔL) and the change (ΔV) from the target speed is linear, but this relationship could be a non-linear function f such as $\Delta V = f(\Delta L)$. In addition, in order to control the slack even more precisely, the change ΔV could be determined for integral control (integral of deviation×gain Gi) or derivative control (derivative of deviation×gain Gd) instead of proportional control (deviation×gain G) as described above. In such cases, function f and the PID control method (equations for G, Gi, Gd, ΔV) are determined in advance and stored as relationship information.

When a stop paper feed command is received from the print control unit 21 after constant-speed conveyance as described above (step S7), the conveyance control unit 22 stops driving the supply roller 29 and conveyance roller 30 (step S8). This control can simply and quickly reduce the speed of both rollers to zero, but preferably stops both rollers so that the paper feed distance of both rollers in the current conveyance operation is the same. This more reliably maintains slack in the paper 26 between the supply roller 29 and conveyance roller 30 when the conveyance operation starts.

When the rollers are stopped and the current conveyance operation ends as described above, the conveyance control unit 22 determines the wait time ΔT of the next conveyance operation from the drive status of the supply roller 29 and conveyance roller 30 in the current conveyance operation, and overwrites the value previously stored in RAM with the new wait time ΔT (step S9).

Because this wait time ΔT is used to eliminate the difference in the paper feed distance resulting from the difference in the behavior of the supply roller 29 and conveyance roller 30 when driving starts, a method that determines the wait time ΔT from the behavior of both rollers when driving starts can be used. More specifically, one method determines the wait time ΔT from the difference in the rise times of the supply roller 29 and conveyance roller 30 as described above.

Figure 5A:
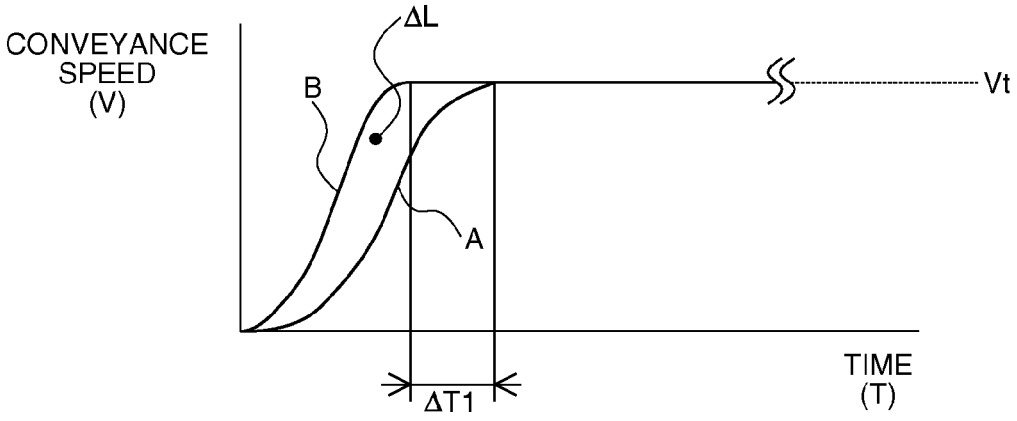
FIGS. 5A and 5B describe wait time ΔT.
Figure 5B:
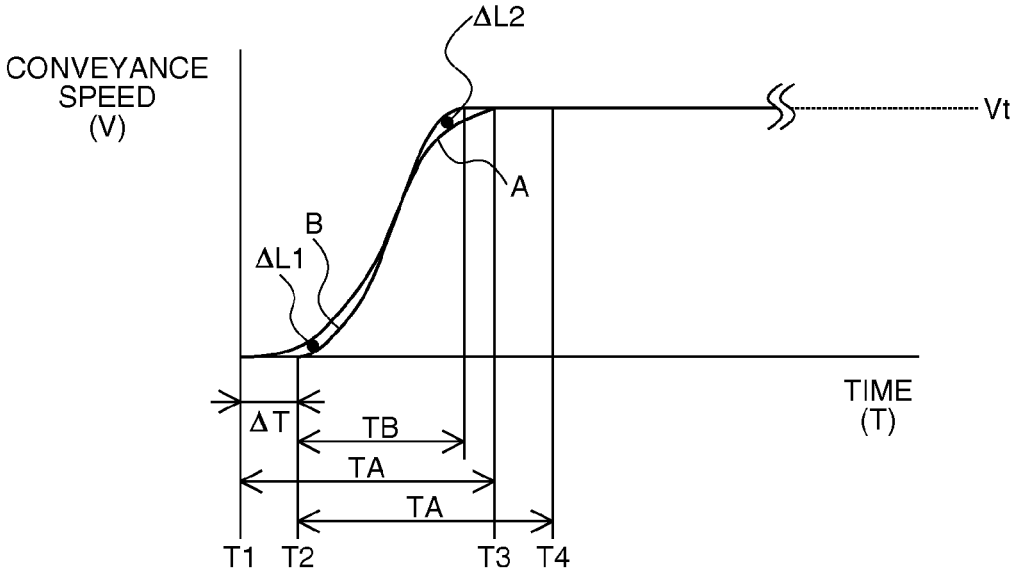

FIGS. 5A and 5B describe the wait time ΔT. FIG. 5A is similar to the graph in FIG. 2, and shows the change in speed over time when the driving of the supply roller 29 (curve A) and conveyance roller 30 (curve B) starts simultaneously. The difference in the rise time is ΔT1. More specifically, ΔT1 is the difference in the time required for each roller to reach the specific speed Vt target after driving the roller starts.

FIG. 5B shows the change over time in the conveyance speed of the supply roller 29 (curve A) and conveyance roller 30 (curve B) when the printer 2 is controlled as described with reference to FIG. 3. As described above, starting the driving of the conveyance roller 30 as indicated by curve B is delayed wait time ΔT from the start of the driving of the supply roller 29 indicated by curve A.

As a result, the amount conveyed by both rollers is substantially the same (the areas of ΔL1 and ΔL2 in the figure are substantially the same) by the time the two rollers both the specific speed Vt target (T3 in the figure), and slack in the paper 26 remains substantially constant during the conveyance operation.

Because the rise time difference ΔT1 and the wait time ΔT are substantially proportional, the proportional gain k1 of ΔT=k1×ΔT1 is experimentally determined, and is stored in NVRAM as the relationship information described above. This method therefore determines the time required for supply roller 29 and conveyance roller 30 to reach the specific speed after driving starts, determines TA and TB in the example in FIG. 5B, calculates ΔT1 from the difference therebetween, and then uses the proportional gain k1, the above relationship information, to determine the wait time ΔT from the relationship ΔT=k1×ΔT1.

Note that the drive data stored in RAM as described above is used for control during constant-speed conveyance and to determine the wait time ΔT, and this data is appropriately acquired and stored by the conveyance control unit 22. The conveyance speeds of the supply roller 29 and conveyance roller 30, and the duty of the motors 27 (the current supplied to the motors 27 in this example) are also stored at a specific time interval.

A second method determines the wait time ΔT from the media conveyance difference ΔL while the supply roller 29 and conveyance roller 30 rise to the specific speed Vt.

Because the conveyance difference ΔL and the wait time ΔT are substantially proportional, the proportional gain k2 of ΔT=k2×ΔL is experimentally determined, and is stored in NVRAM as relationship information. This method therefore determines the amount of paper 26 conveyed by the supply roller 29 and the conveyance roller 30 between when driving each roller starts and when the supply roller 29 reaches the specific speed after driving starts (TA shown in FIG. 5B), calculates ΔL from the difference therebetween, and then uses the proportional gain k2, the above relationship information, to determine the wait time ΔT from the relationship ΔT=k2×ΔL.

In the example shown in FIG. 5B, the conveyance distance during acceleration of the supply roller 29 is the conveyance distance from time T1 to T3, the conveyance distance during acceleration of the conveyance roller 30 is the conveyance distance from time T2 to T4, and ΔL is calculated from the difference between these amounts.

A third method is described next. This method measures the difference in the behavior of the supply roller 29 and conveyance roller 30 when drive starts based on the duty difference ΔD of the drive motors 27 of the supply roller 29 and conveyance roller 30 after the specific speed Vt is reached. More specifically, the wait time ΔT is determined from the duty difference ΔD.

Figure 6:
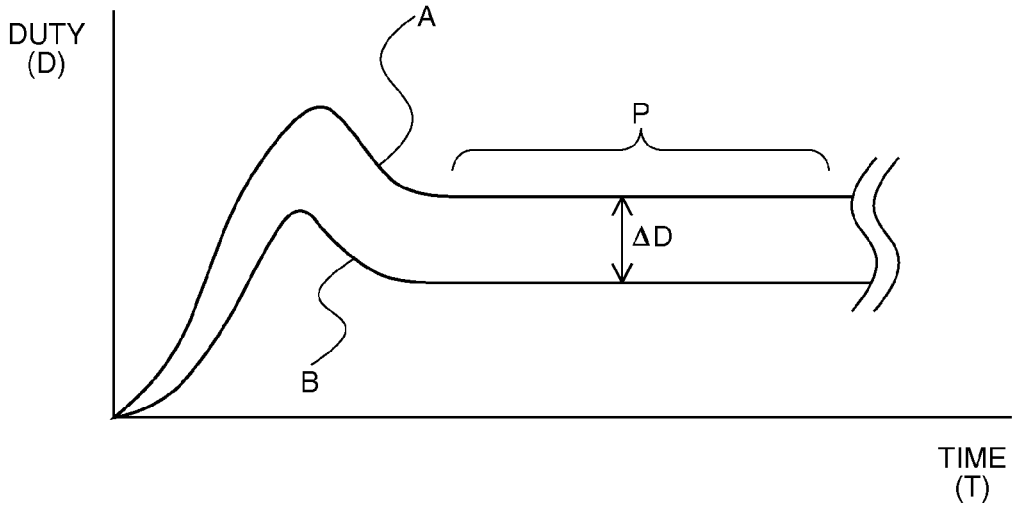
FIG. 6 shows an example of change in the duty of motors 27A and 27B over time.

FIG. 6 shows an example of the change over time in the duty of motors 27A and 27B. The duty expresses the current supplied to the motors 27 as a relative value, and a greater value indicates the force that should be applied to the roller is greater.

FIG. 6 shows the duty of the motor 27A (curve A) and motor 27B (curve B) from the start of the driving of the supply roller 29 and conveyance roller 30. Because great force is required to start, the duty rises to a peak as shown in FIG. 6, and then settles to a substantially constant duty after the target speed is reached.

That the duty is greater for one of the two rollers to be controlled to the same target speed means that the drive load (the power required to drive the roller) is greater, that is, that the back tension on the supply roller 29 is greater. The delay in the rise of the roller speed when drive starts can therefore be determined from the duty difference. This method therefore determines the wait time ΔT from the duty difference. Because the duty varies greatly and is not stable, the duty difference used at the start of drive control is the duty difference ΔD during the stable period (such as period P in FIG. 6) after the specific speed is reached and becomes stable.

Because the duty difference ΔD and the wait time ΔT are substantially proportional, the proportional gain k3 of ΔT=k3×ΔD is experimentally determined, and is stored in NVRAM as relationship information described above. This method therefore determines the typical duty of each roller after the supply roller 29 and conveyance roller 30 reach the specific speed, calculates ΔD from the difference therebetween, and then uses the proportional gain k3, the above relationship information, to determine the wait time ΔT from the relationship ΔT=k3×ΔD.

Note that this typical duty could be the average of plural duty values detected in a preset time.

The relationship between the information for determining the wait time (ΔT1, ΔL, ΔD, referred to generally as ΔX) and the wait time ΔT is linear in the three methods described above, but this relationship could be expressed as a non-linear function f where $\Delta T=f(\Delta X)$. In this case, function f is determined in advance and stored as relationship information.

When the wait time $\Delta T$ is thus determined, stored in RAM, and updated (step S9), the control process for the conveyance operation ends, and the same process thereafter repeats in the next conveyance operation.

Because the relationship between the information for determining the wait time ($\Delta T$1, $\Delta L$, $\Delta D$) and the wait time differs according to the type of paper 26, the relationship information described above could be prepared and stored for different types of paper used in the printer 2.

Control based on the wait time $\Delta T$ and control that changes the target speed of the supply roller 29 are both used to maintain a constant amount of slack in the paper 26 in the embodiment described above, but a configuration that uses only the latter is also possible.

Figure 7:
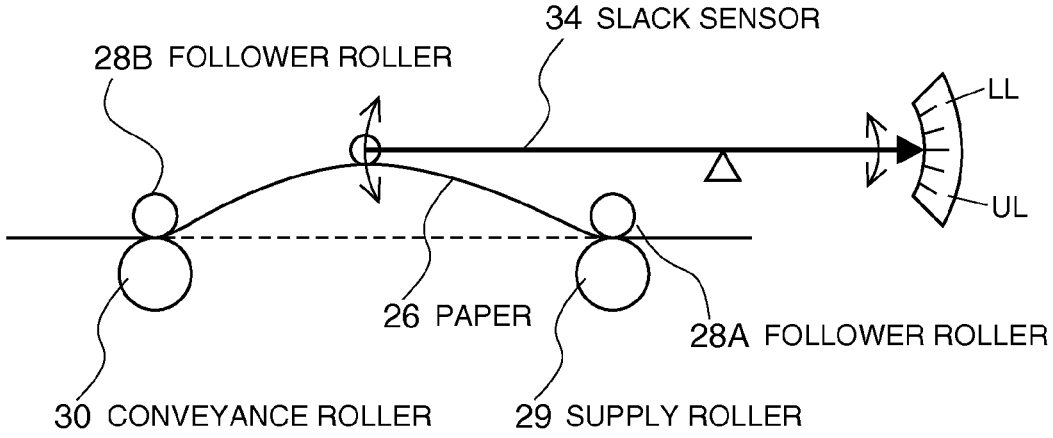
FIG. 7 shows an example of a slack sensor 34.

A configuration that complements the control used in the above embodiment with control using a slack sensor to avoid problems is also conceivable. FIG. 7 schematically describes an example of a slack sensor 34 in this embodiment. This embodiment adds a slack sensor 34 (slack detector) such as shown in FIG. 7 to the configuration shown in FIG. 1, and uses the slack sensor 34 to keep the slack in the paper 26 between the supply roller 29 and conveyance roller 30 within a tolerance range. The slack sensor 34 therefore has a function for detecting the upper limit (UL) and lower limit (LL) of this slack.

The upper limit of slack is the threshold which if exceeded could result in conveyance problems such as the paper touching parts along the conveyance path 33, and FIG. 7 shows the maximum position to which the paper 26 can rise. The lower limit is the threshold at which back tension would be applied to the conveyance roller 30 if the amount of slack went below the threshold, and FIG. 7 shows the lowest position to which the paper 26 slack can go.

The slack sensor 34 shown in FIG. 7 has a distal end that always lightly touches the paper 26 and moves up and down according to the slack in the paper 26, an arm that pivots on a fulcrum as the distal end moves up and down, and a detector part that senses the movement of the opposite end of the arm as the distal end. The slack sensor 34 outputs to the conveyance control unit 22 when the detector part reaches the upper limit (UL) or the lower limit (LL).

Note that the slack sensor 34 shown in FIG. 7 is one example, and an optical sensor, contact sensor, or other type of sensor that can detect the upper and lower limits of slack can be used as the slack sensor.

Control in the foregoing embodiment maintains a certain amount of slack when the conveyance operation starts by applying control based on the drive state in the previous conveyance operation (control based on the wait time) and real-time control based on the current actual conveyance difference, but cumulative measurement error from the encoders 31A and 31B could result in the slack that should remain constant gradually increasing or decreasing. A failure of some kind could also result in normal control suddenly not being possible and the slack suddenly changing.

The purpose of a configuration adding a slack sensor is to avoid problems resulting from such occurrences, and in addition to control as described in the embodiment above, the conveyance control unit 22 applies control that stops the conveyance operation, or resets the conveyance difference $\Delta L$ during real-time control based on the conveyance difference (control that changes the target speed of the supply roller 29), when the slack sensor 34 detects slack at the upper limit (UL) or the lower limit (LL).

Because the conveyance operation stops immediately in the former case, problems such as slack increasing too much and causing a paper jam, and slack decreasing too much and causing printing problems due to back tension on the conveyance roller 30, can be avoided.

In the latter case, control that changes the conveyance difference $\Delta L$ when slack reaching the upper limit or the lower limit is detected to a reset value that is predefined for the upper limit or lower limit, and then updates the reset value based on the subsequent conveyance difference, is applied. More specifically, control that changes the target speed of the supply roller 29 according to the conveyance difference $\Delta L$ that is thus reset is applied. This reset value is the difference between the length of the paper 26 between the rollers (the supply roller 29 and conveyance roller 30) when the amount of slack to be held constant is created when the paper is first loaded, and the length of the paper 26 between the rollers when the upper limit or the lower limit is reached, and this predetermined value is stored in NVRAM.

By thus adding control using a slack sensor 34, cumulative measurement error can be eliminated and more accurate control is possible.

As described above, because the paper feed system of the printer 2 according to this embodiment of the invention is controlled in real time to eliminate the difference in the conveyance distance based on the difference in the length of media conveyed by both rollers (supply roller 29 and conveyance roller 30) detected at that time, the amount of slack between the rollers when the conveyance operation starts can be maintained substantially constant, and the paper 26 can be precisely conveyed without contacting parts disposed to the conveyance path 33 even when space along the conveyance path 33 is limited. The effect of back tension on the conveyance roller 30 can therefore be consistently avoided without increasing device size. As a result, paper can be conveyed at a constant speed to the printing position, and high quality printer is possible.

Furthermore, even more accurate control is possible by disposing the encoders 31A and 31B that are used in the control method described above to detect the speed of both rollers to the follower rollers 28A, 28B, respectively.

More appropriate control is also enabled by changing (correcting) the relationship information G described above according to the type of paper or roll diameter.

The conveyance difference of both rollers that occurs during roller acceleration can also be eliminated earlier, and more accurate control can be achieved, by applying control that appropriately delays the start of conveyance roller 30 operation based on immediately preceding conditions.

The conveyance method also works more effectively in a device that uses paper roll 25, which can easily cause the back tension on the supply roller 29 to change.

Furthermore, a safer conveyance operation is enabled and control accuracy can be improved by adding control using a slack sensor 34.

While the print medium is paper in the embodiment described above, the invention is not so limited and can be used with other types of sheet media.

The invention being thus described, it will be clear that it may be varied in many ways. Such variations are not to be regarded as a departure from the spirit and scope of the invention, and all such modifications as would be understood by one skilled in the art are intended to be included within the scope of the following claims.

What is claimed is:

1. A conveyance device comprising:

an upstream roller that supplies a sheet medium to be processed to a conveyance path;

a downstream roller that conveys the supplied medium to a processing position;

at least two encoders respectively sensing the speed of the upstream and downstream rollers, and a conveyance control unit that is configured to convey the sheet medium at a target speed, $V_t$, by driving the upstream roller and the downstream roller, and the conveyance control unit is further configured to change the target speed of the upstream roller to eliminate a conveyance difference, which is a difference between a length of media conveyed by the upstream roller and a length of media conveyed by the downstream roller from a start of a conveyance operation, based on the conveyance difference;

wherein the conveyance control unit is configured to control the change of the target speed of the upstream roller and downstream roller by way of a proportional intergral derivative (PID) controller based on output from the at least two encoders, wherein the conveyance control unit is further configured to control the start time of driving the upstream roller to be before the start time of driving the downstream roller.

2. The conveyance device described in claim 1, further comprising:

follower rollers respectively disposed opposite the upstream roller and the downstream roller with the sheet medium therebetween; and wherein the conveyance control unit determines the conveyance difference based on information detected by the at least two encoders.

3. The conveyance device described in claim 1, the conveyance control unit further including:

a memory unit configured to store relationship information related to the conveyance difference and the target speed of the upstream roller, wherein the target speed is changed according to the relationship information.

4. The conveyance device described in claim 3, wherein:

the relationship information is stored for different types of sheet media.

5. The conveyance device described in claim 1, further comprising:

a slack detector that is configured to detect the amount of slack in the sheet medium between the upstream roller and the downstream roller, and the conveyance control unit is configured to correct the conveyance difference with a conveyance operation based on a predetermined value and changes the target speed after the slack detector detects that the amount of slack in the sheet medium reached a predetermined upper limit or lower limit.

6. The conveyance device described in claim 5, wherein:

the conveyance operation is stopped when the slack detector detects that the amount of slack in the sheet medium reached the predetermined upper limit or lower limit.

7. The conveyance device described in claim 1, further including a roll that supplies the sheet medium to the upstream roller.

8. The conveyance device described in claim 1, wherein:

the conveyance control unit determines the starting time of the upstream roller and the downstream roller when starting the conveyance operation based on drive information of the upstream roller and the downstream roller in a previous conveyance operation.

9. A printing device that comprises the conveyance device described in claim 1, and prints on the sheet medium at the processing position.

10. The conveyance device described in claim 1, wherein the upstream roller and the downstream roller are independently driven by two separate motors.

11. A conveyance method for a conveyance device including an upstream roller that supplies a sheet medium to be processed to a conveyance path, a downstream roller that conveys the supplied medium to a processing position, and a conveyance control unit, the conveyance method comprising:

starting to drive the upstream roller before starting to drive the downstream roller, controlling the driving of the upstream roller and the downstream roller using a constant target speed, sensing the speed of the downstream and upstream rollers with respective encoders;

changing the target speed of the upstream roller to eliminate a conveyance difference between a length of media conveyed by the upstream roller and a length of media conveyed by the downstream roller, from the start of the conveyance operation, based on the conveyance difference in each conveyance operation, and controlling the upstream roller and downstream roller with a proportional integral derivative (PID) controller based on output from the respective encoders.

12. The conveyance method described in claim 11, further including:

detecting the amount of slack in the sheet medium between the upstream roller and the downstream roller; and correcting the conveyance difference based on a predetermined value; and changing the target speed after detecting that the amount of slack in the sheet medium reached a predetermined upper limit or lower limit.

13. The conveyance method described in claim 12, further including:

stopping conveyance when the amount of slack in the sheet medium reaches the predetermined upper limit or lower limit.

14. The conveyance method described in claim 11, wherein the upstream roller and the downstream roller are independently driven by two separate motors.

* * * * *